US005823572A

United States Patent [19]

NakaMats

[11] Patent Number: 5,823,572

[45] Date of Patent: Oct. 20, 1998

[54] SELF DEFENSE WEAPON WITH MEMO

[76] Inventor: Yoshiro NakaMats, Landic No. 2 Akasaka Bldg. No. 10-9, 2-chome, Akasaka, Minato-ku, Tokyo 107, Japan

[21] Appl. No.: 727,099

[22] Filed: Oct. 8, 1996

[51] Int. Cl.[6] ..... B42D 1/00

[52] U.S. Cl. ..... 281/2; 281/5; 281/15.1; 281/51; 402/80 R; 283/63.1

[58] Field of Search ..... 281/2, 5, 15.1, 281/22, 34–38, 51; 283/2–4, 45, 46, 48.1, 50, 56, 60.1, 60.2, 61, 62, 63.1, 117; 40/492, 497, 536, 533; D19/28, 29, 30, 31; 30/135, 340–344

[56] References Cited

U.S. PATENT DOCUMENTS

| | | | |
|---|---|---|---|
| 3,877,729 | 4/1975 | Friedman | 281/37 |
| 4,313,230 | 2/1982 | Chovaniec | 2/322 |
| 4,828,289 | 5/1989 | Korner | 281/15.1 |
| 4,840,406 | 6/1989 | Pitts | 402/4 |
| 5,255,438 | 10/1993 | Morgan | 30/254 |
| 5,365,666 | 11/1994 | Gonzalez | 30/340 |
| 5,692,265 | 12/1997 | Dalury | 16/111 R |

*Primary Examiner*—Frances Han
*Attorney, Agent, or Firm*—Jordan and Hamburg

[57] ABSTRACT

A self defense weapon for use by a victim subject to being attacked by a perpetrator includes a memo pad having a plurality of pages. The memo pad has a plurality of edges and an indentation in at last one of the edges adapted to accept at least part of at least one finger or the victim's hand such that the indentation facilitates the victim's capability to firmly grasp and hold the memo pad in the victim's hand, whereby the memo pad can thereby be used by the victim as a self defense weapon to ward off perpetrators.

19 Claims, 3 Drawing Sheets

SELF DEFENSE WEAPON WITH MEMO

BACKGROUND OF THE INVENTION

This invention relates to a self defense weapon formed as a memo pad and which is easily held by a person's fingers, therefore making it possible to provide protection from a mugger and also to quickly and easily write a record or a message without failure of missing or forgetting significant information under a stressful situation. For example the situation might be like a newspaper reporter having no desk but firmly holding the memo pad by his hand.

Conventional self defense devices include buzzers, alarms, etc., but such devices are heavy, bulky and expensive. The present invention is light weight, thus it is easily put in a handbag. Also it is inexpensive and also information on the mugger's appearance, height, time, location, etc. can be written on the memo pad.

A conventional memo pad has a square shape with straight side faces and is inconvenient to hold by one hand and unless properly or carefully handled, there is a risk of the memo pad sliding down to the wrist. Also there may be a case where the memo pad cannot be properly held, resulting in writing difficulty. Especially for persons requiring writing speed such as newspaper reporters or stenographers who are standing, there is a need for a memo pad which facilitates easy writing.

SUMMARY OF THE INVENTION

This invention resolves this problem in that the shape of the memo pad is suitable to enable placing a thumb and the other fingers on opposite sides of the memo pad so as to provide for firmly holding the side faces of the memo pad by the fingers. The memo pad has indentations in the shape of a person's fingers on the side faces of the memo pad.

DESCRIPTION OF THE PREFERENCE EMBODIMENTS

Figure 1:
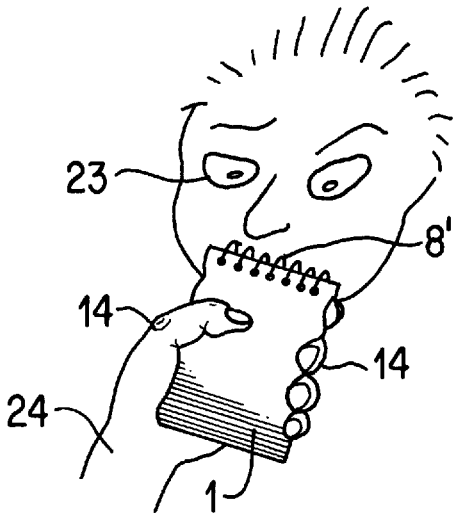
FIG. 1 is schematic view showing how to use this invention.
Figure 2:
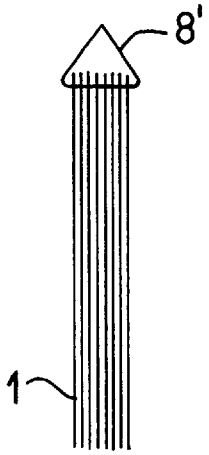
FIG. 2 is a partial elevational view of a first embodiment of this invention.

FIG. 1 shows an example of this invention wherein when a lady is walking alone on the street and somebody tries to attack her, she will take out this invention from her handbag and hold it firmly by her fingers 14 and using her forearm 24 attempt to stab the muggers eyes 23. A binding spiral 8' is of a triangular shape or other sharp shape which makes it more effective to ward off muggers as shown in FIG. 2. Then the mugger will hesitate and the victim can escape from the mugger. Also the victim can write down a description of the mugger and other significant information on the memo page by opening the memo pad weapon.

Figure 3:
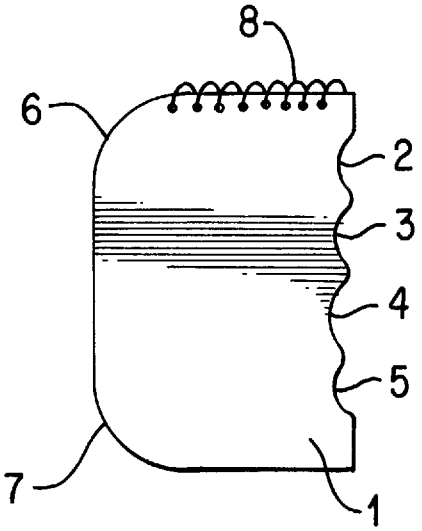
FIG. 3 is an elevational view of a second embodiment of this invention.

FIG. 3 shows an example of this invention wherein indentations 2, 3, 4 and 5 are vertically arranged in the paper sheets of the memo pad. These indentations on the side faces of the memo pad are arranged so as to fit the section of a person's fingers. The memo pad 1 has round corners at the left upper 6 and lower 7 sides. A spiral binding is indicated at 8.

Figure 4:
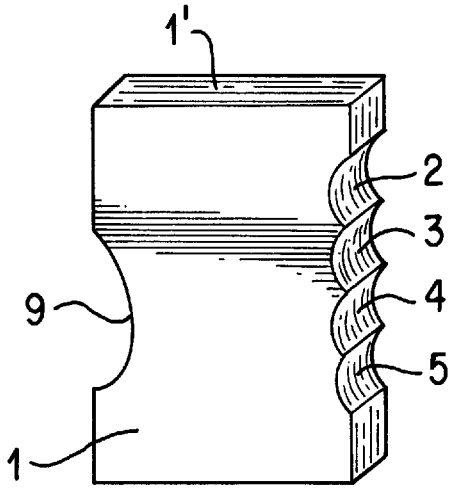
FIG. 4 is a perspective view showing a third embodiment of this invention.

FIG. 4 shows another example of this invention wherein one side of the memo pad is bound by glue 1' instead of a spiral binder and the left side has an indentation 9 suitable to be held by the root of a person's thumb. This embodiment helps to increase the effect of firmly holding the memo pad and preventing slippage and to lighten the load on the fingers.

Figure 5:
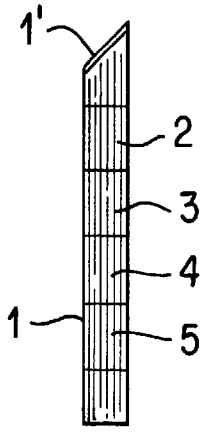
FIG. 5 is an elevational view showing a fourth embodiment of this invention.

The above glue binding edge 1' in FIG. 5 is slanted to form a sharp edge to stab a mugger. Also horizontal holding indentations 2, 3, 4 and 5 are provided as shown in FIG. 5.

Figure 6:
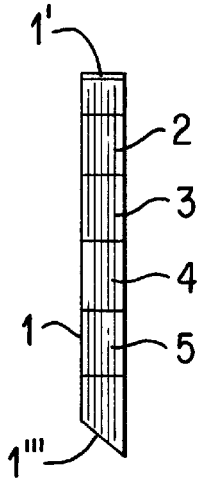
FIG. 6 is an elevational view showing a fifth embodiment of this invention.

In the embodiment of FIG. 6, the opposite side 1''' of glued edge 1' has a sharp edge.

Figure 7:
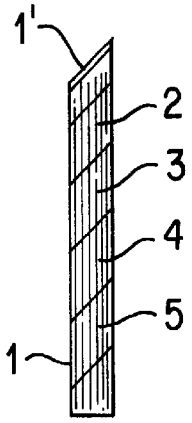
FIG. 7. is an elevational view showing a sixth embodiment of this invention.

FIG. 7 shows another example of this invention with slanted or inclined indentations 2', 3', 4' and 5' for a person's fingers.

Figure 8:
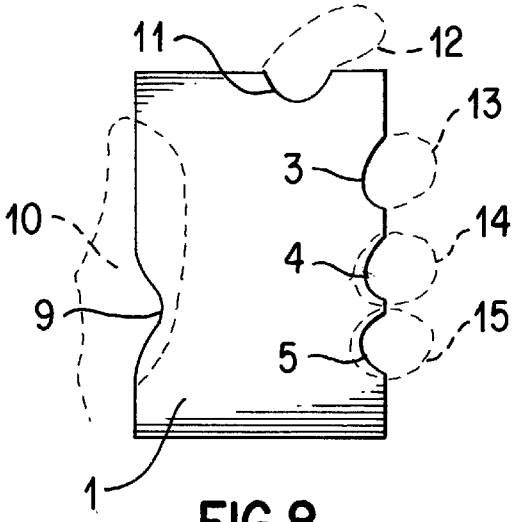
FIG. 8 is an elevational view showing a seventh embodiment of this invention.

FIG. 8 is an example of this invention wherein in addition to the indentation 9 for the thumb 10, an indentation 11 for the forefinger 12 is provided on the upper side of the memo pad. If the forefinger 12 of the left hand is placed on indentation 11 and the middle finger 13, medical finger 14 and small finger 15 are placed on indentations 3, 4 and 5 on the right side, holding of memo pad becomes more secure and makes it possible to use the memo pad even in windy outdoors situations. Also the arrangement of holding the memo pad in this way is natural and comfortable. The use of the indentation 11 provides an effective way to stab a mugger.

Figure 9:
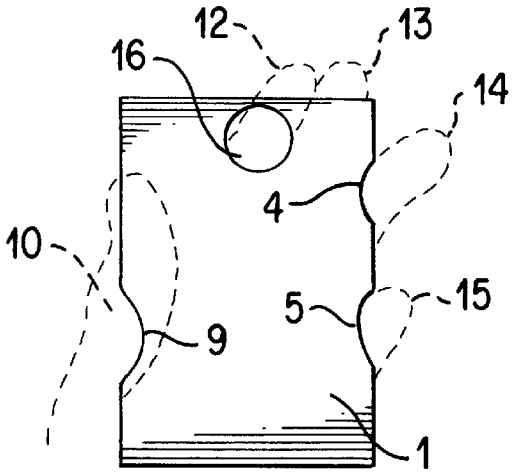
FIG. 9 is an elevational view showing an eighth embodiment of this invention.

FIG. 9 shows an example of this invention wherein a hole 16 is provided at an edge of the memo pad such that the memo pad can be easily and firmly held by inserting the tip of the forefinger 12 onto the surface 1 of the memo pad through the hole 16 and supporting the memo pad from the back side by the middle finger 13. The thumb 10 is placed in indentation 9 on the left side and medical finger 14 and small finger 15 are placed in indentations 4 and 5 on the right side respectively, resulting in close contact between the back side of the memo pad 1 and the palm to provide an effect of increasing writing easiness. Hole 16 also can be used as a filing hole.

Figure 10:
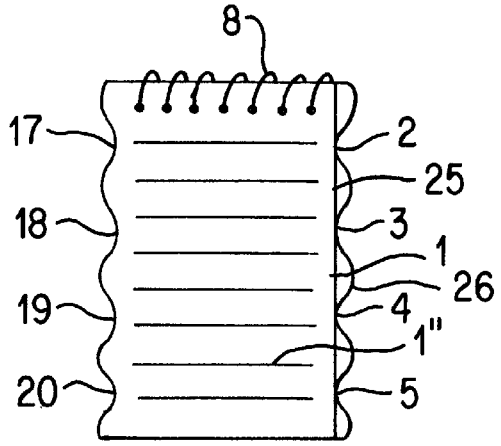
FIG. 10 is an elevational view showing a ninth embodiment of this invention.

FIG. 10 is an example of this invention wherein four indentations each 2, 3, 4, 5, 17, 18, 19 and 20 are provided on both the left and right sides to enable holding the memo pad by either the left hand or the right hand. Thus, the memo pad in FIG. 10 can be used regardless of whether use by a right-handed person or a left-handed person. Furthermore, as regards the spiral binding 8, even when turning a used page to the back side, the indentations of the used page will match those of the unused pages, so that it is convenient to hold the memo pad while it is turned to any page. The above spiral 8 can be triangular (as shown in FIG. 2), round, or any other shape.

In FIG. 10, ill indicates a plurality of parallel ruled lines printed on both sides of the paper to facilitate writing a memo. A solid line 25 is printed or formed as punched holes in the paper along the inner part of the indentations 2 through 5 or a perforated line is provided to facilitate tearing paper from the memo pad along with the indentations 2 through 5. If a plurality of indentations from a plurality of pages are torn off along the line 26, for example, it is easy to particularly sort or identify specific pages. Furthermore, in case of a spiral binding, even when turning used page to the back side, indentations of used page match with those of the unused pages so that it is convenient both for holding and reference.

Figure 11:
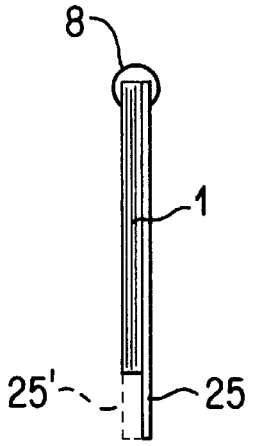
FIG. 11 is an elevational view showing a tenth embodiment of this invention.
Figure 12:
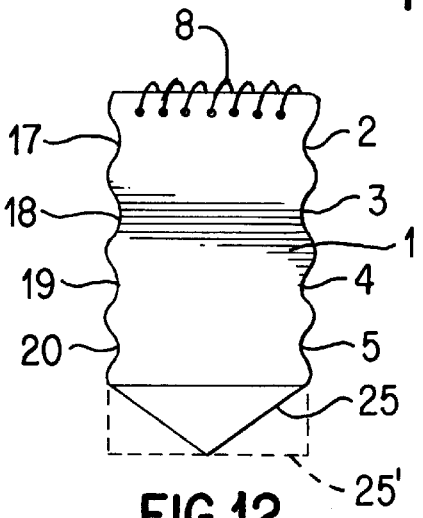
FIG. 12 is an elevational view showing an eleventh embodiment of this invention.

FIG. 11 and FIG. 12 show another example of this invention wherein one side or both sides of paper 25, 25' are made harder and thicker or stronger to make a larger size. The shape of the bottom can be triangular, square or any size as show in FIG. 12, and will work as a weapon.

Figure 13:
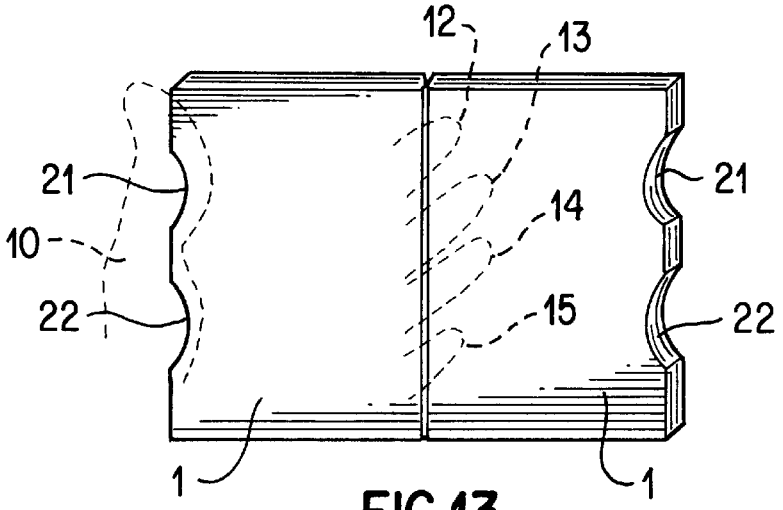
FIG. 13 is a perspective view showing a twelve embodiment of this invention.

FIG. 13 is an example of this invention wherein the binding line is vertical like books. The memo pad has two indentations 21 and 22 fitting to a person's thumb on one side which is the opposite side of the bound side. When using the memo pad by spreading and opening the pages as shown in FIG. 13, it is possible to steadily hold and use the memo pad at its opening stage as shown in FIG. 13 by putting the root and tip of the thumb 10 into indentations 12 and 13 of one side and supporting the memo pad with the other fingers 12, 13, 14 and 15 from below. Also it can be used regardless of whether the person using it is right handed or left handed.

One or both covers of the memo pad may be made of cardboard, paperboard, wood, plastic or fiberglass or combinations or composites of these materials.

Besides the actual examples set forth above, various positions and shapes of indentations can be used and such varied versions are considered parts of this invention.

What I claim is:

1. A self defense weapon for use by a victim subject to being attacked by a perpetrator comprising a memo pad having a plurality of pages, said memo pad having a plurality of edges, an indentation means in at least one of said edges adapted to accept at least part of at least one finger of said victim's hand such that said indentation means facilitates the victim's capability to firmly grasp and hold the memo pad in the victim's hand, whereby the memo pad can thereby be used by said victim as a self defense weapon to ward off said perpetrator.

2. A self defense weapon according to claim 1 wherein said memo pad comprises a binding means for binding said plurality of pages, said binding means forming a sharp outer edge.

3. A self defense weapon according to claim 2 wherein said binding means includes two sides which meet along a common intersection to form said sharp outer edge.

4. A self defense weapon according to claim 2 wherein said binding means comprises a spiral binder with each 360 turn of the spiral binder having the configuration of a triangle.

5. A self defense weapon according to claim 1 wherein said indentation means comprises four finger indentations in one edge of said memo pad.

6. A self defense weapon according to claim 5 wherein said memo pad includes an opposite edge opposite side one edge, said indentation means further comprising a fifth finger indentation in said opposite edge.

7. A self defense weapon according to claim 1 wherein said memo pad comprises a binding means for binding said plurality of pages, said memo pad having a planar side, said binding means comprises an adhesive adhesively joining one edge of the pages of said memo pad, said adhesively joined edges forming a generally planar binding surface, said planar binding surface being disposed at an acute angle relative to said planar side of the memo pad to thereby provide a sharp edge at the intersection of said planar binding surface and said planar side of said memo pad.

8. A self defense weapon according to claim 1 wherein memo pad has two sides, said memo pad having a closed disposition in which said two sides are parallel and spaced from one another, said indentation means extending longitudinally between said two sides, said indentations means having a longitudinal axis disposed at an acute angle relative to said two parallel sides.

9. A self defense weapon according to claim 8 wherein said memo pad includes binding means adhesively joining one edge of the pages of the memo pad, said adhesively joined edges forming a generally planar binding surface, said planar binding surface being substantially parallel to said longitudinal axis of said indentation means.

10. A self defense weapon according to claim 1 wherein said indentation means includes finger indentations along three different edges of said memo pad.

11. A self defense weapon according to claim 1 further comprising a through hole through said memo pad through which one of said victim's fingers can pass.

12. A self defense weapon according to claim 1 wherein said indentation means comprises a plurality of indentations disposed as an indentation unit along said one edge of said memo pad, and separable means between said memo pad and said indentation unit to facilitate separation of said indentation unit from said memo pad.

13. A self defense weapon according to claim 12 wherein said separable means comprises perforations.

14. A self defense weapon according to claim 1 wherein said memo pad has a front cover and a back cover, at least one of said covers having a bottom edge having converging edge portions which converge to form a pointed end.

15. A self defense weapon according to claim 14 wherein said plurality of pages comprise a plurality of paper sheets between said front and back covers, said paper sheets being shorter than said at least one cover such that said paper sheets do not underlie said converging edge portions.

16. A self defense weapon according to claim 1 wherein said indentation means comprises two indentations with one of said indentations being configured to receive the tip of the thumb of one hand of the victim and the other indentation is configured to receive the root of said thumb of said same one hand of said victim.

17. A self defense weapon according to claim 1 wherein said memo pad has at least one cover, said plurality of pages comprising a plurality of paper sheets, said at least one cover being thicker than said paper sheets.

18. A self defense weapon according to claim 1 wherein said memo pad has at least one cover, said plurality of pages comprising a plurality of paper sheets, said at least one cover being made of a rigid material.

19. A self defense weapon according to claim 18 wherein said rigid material is selected from the group consisting of cardboard, paperboard, wood, plastic and fiberglass.

* * * * *